US006865846B2

(12) United States Patent
Hsu

(10) Patent No.: US 6,865,846 B2
(45) Date of Patent: Mar. 15, 2005

(54) CONNECTION STRUCTURE FOR SIDE BRACKET OF DOOR/WINDOW VENETIAN BLIND

(75) Inventor: Pey-Son Hsu, Changhua Hsien (TW)

(73) Assignee: Ching Feng Blinds Inc. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/436,194

(22) Filed: May 13, 2003

(65) Prior Publication Data

US 2004/0226219 A1 Nov. 18, 2004

(51) Int. Cl.[7] ..... E06B 7/08; E06B 1/04
(52) U.S. Cl. ..... 49/74.1; 49/504
(58) Field of Search ..... 49/504, 501, 505, 49/74.1, 92.1; 52/473, 656.7, 656.1, 217, 202, 204.1, 212, 204.55

(56) References Cited

U.S. PATENT DOCUMENTS 96,753 A * 11/1869 Williams ..... 49/74.1
3,782,051 A * 1/1974 Quinif ..... 52/473
5,419,085 A * 5/1995 Imbur ..... 49/398
6,076,305 A * 6/2000 Hsu ..... 49/505
6,474,034 B1 * 11/2002 Dronigi ..... 52/473
6,691,461 B1 * 2/2004 Gitkin ..... 49/74.1
6,732,475 B1 * 5/2004 Lee ..... 49/505

* cited by examiner

*Primary Examiner*—Hugh B. Thompson, II
(74) *Attorney, Agent, or Firm*—Troxell Law Office, PLLC

(57) ABSTRACT

A connection structure for side bracket of door/window Venetian blind comprises a pair of Venetian door/window units, two decoration connection boards, an upper and a lower frames mounted onto the top and bottom edges of both Venetian door/window units respectively, and a stop plate fixed to the middle of a preset frame for location of both door/window units thereof in closing manner. Each Venetian door/window unit has a plurality of pivot couplers equidistantly disposed at one side thereof to be pivotally registered with coupling holes disposed at a stepwise pivot face of each decoration connection board. The other side of each decoration connection board has a front decoration face with various kinds of patterns disposed thereon, and a rear adjustment section via which the door/window Venetian blind thereof can be adjusted to preset frames of a wide range. The decoration connection boards are directly mounted onto outer walls defined by the preset frame to form a closed space there-between, effectively sheltering sun or wind from coming in there-through as well as achieving the overall beauty of the door/window Venetian blind in display.

1 Claim, 5 Drawing Sheets

PRIOR ART FIG. 1

PRIOR ART FIG. 2

CONNECTION STRUCTURE FOR SIDE BRACKET OF DOOR/WINDOW VENETIAN BLIND

BACKGROUND OF THE INVENTION

The present invention is related to a connection structure for side bracket of door/window Venetian blind, comprising a pair of Venetian door/window units, two decoration connection boards each pivotally joined to one side of one Venetian door/window unit thereof, an upper and a lower frames mounted onto the top and bottom edges of the door/window units respectively, and a stop plate for location of both door/window units in closing manner. The other side of each decoration connection board is provided with a front decoration face with various kinds of patterns disposed thereon, and a rear adjustment section via which the decoration connection boards are suitably fixed to outer walls of a preset frame of any sizes, effectively sheltering sun or wind from coming in there-through as well as achieving the overall beauty of the door/window Venetian blind in display.

Please refer to FIGS. 1, 2. A conventional connection structure for side bracket of door/window Venetian blind is mainly made up of a pair of door/window units 10, two connection boards 20 pivotally joined at one side of the door/window units respectively. A plurality of equally spaced stepwise through holes 21 are disposed at one side of the connection boards 20 respectively, via which the connection boards 20 thereof are directly secured onto inner walls 41 disposed at both sides of a preset frame 40. Decoration boards 50 are then adapted to outer walls 42 defined by the preset frame 40 and fixedly secured thereto for location.

There are some drawbacks to such conventional connection structure for side bracket of door/window Venetian blind. First, the connection boards 20 are directly fixed to the inner walls 41 of a preset frame 40 that can be either too big or too small for the connection boards 20. In either case, cutting or replacement is troublesomely required for the connection boards 20 to be adapted thereto, which makes the connection boards 20 quite limited in range of use. Second, the connection boards 20 are directly applied to the inner walls 41 of the preset frame 40. In case of uneven surface of the inner walls 41, a gap A might be formed between the inner walls 41 and the connection boards 20 as shown in FIG. 2, making the door/window Venetian blind fail to effectively shelter sun or wind from coming in there-through as well as destroying the overall beauty of the door/window Venetian blind in display. Third, the connection boards 20 and decoration boards 50 are separately assembled onto the door/window units 10, which are both time-consuming and troublesome in assembly. Besides, decoration boards 50 are individually purchased, which is quite uneconomical in the costs of materials and production as well.

SUMMARY OF THE PRESENT INVENTION

It is, therefore, the primary purpose of the present invention to provide a connection structure for side bracket of door/window Venetian blind, comprising a pair of Venetian door/window units, two decoration connection boards, an upper and a lower frames, and a stop plate wherein each decoration connection boards is equipped with a front decoration face and a rear adjustment section disposed at one side thereof. Via the rear adjustment sections thereof, the decoration connection boards can be adjusted and mounted onto a preset frame of any sizes, economically making the decoration connection boards suitable to preset frames of a wide range as well as easier and faster in assembly thereof.

It is, therefore, the secondary purpose of the present invention to provide a connection structure for side bracket of door/window Venetian blind wherein the decoration connection boards are directly mounted onto outer walls defined by the left/right sides of the preset frame, forming a closed space there-between so as to effectively shelter sun or wind from coming in there-through and achieve the overall beauty of the door/window Venetian blind in display as well.

It is, therefore, the third purpose of the present invention to provide a connection structure for side bracket of door/window Venetian blind wherein each decoration connection board having the decoration front face and the rear adjustment section disposed at one side thereof is integrally molded, economically saving the costs of materials and production as well the time of assembly thereof.

DETAILED DESCRIPTION OF THE PREFERRED EMBODIMENTS

Figure 1:
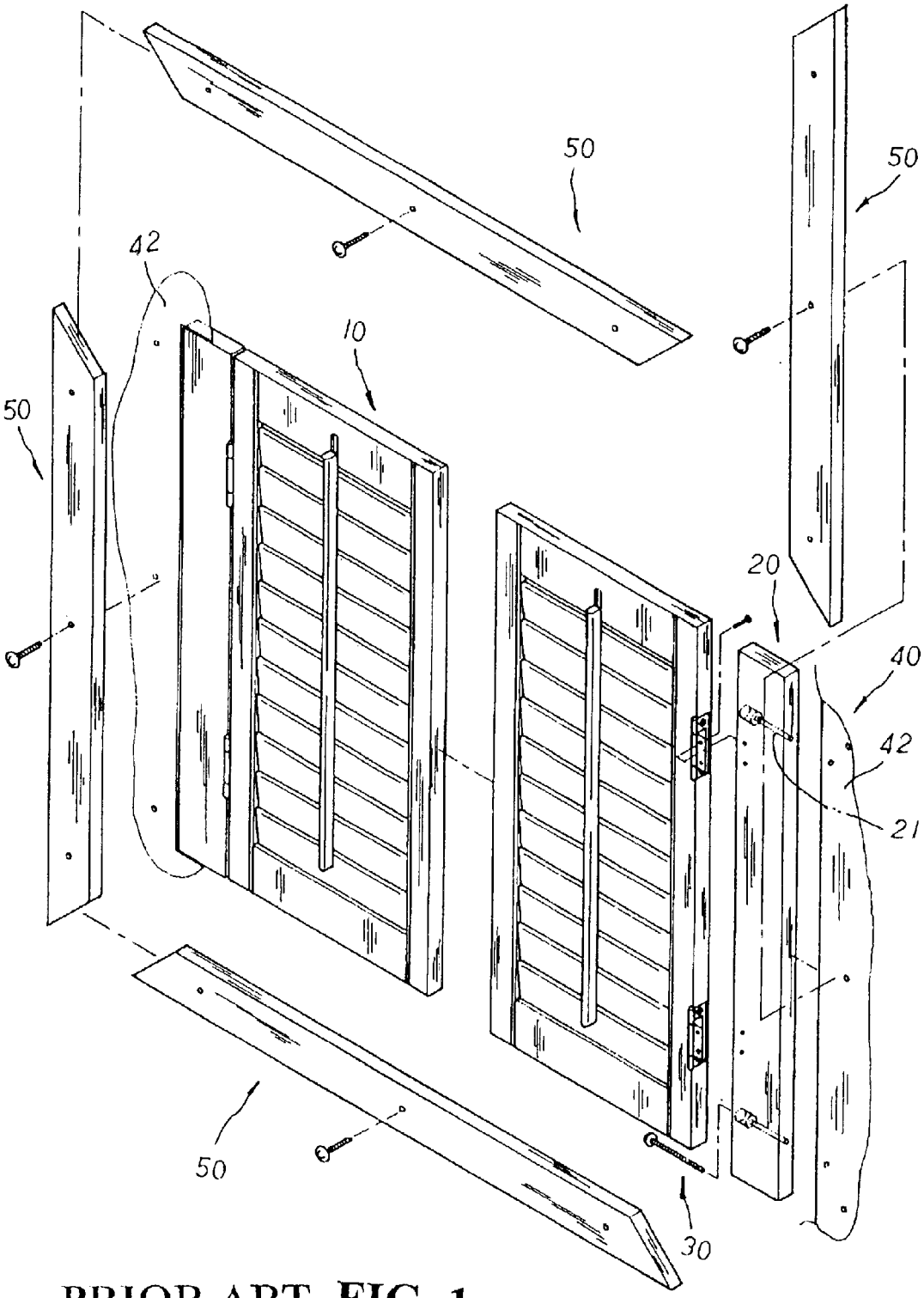
FIG. 1 is a perspective exploded view of a conventional connection structure for side bracket of door/window Venetian blind.
Figure 2:
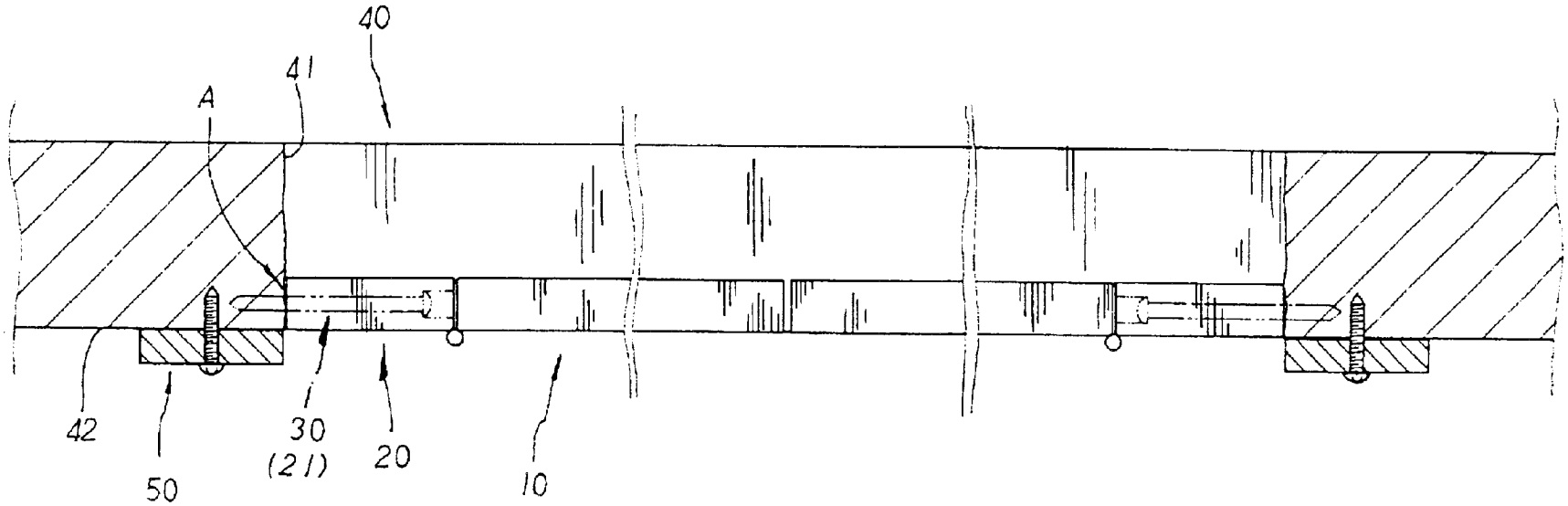
FIG. 2 is a sectional view of the conventional connection structure for side bracket of door/window Venetian blind in assembly.
Figure 3:
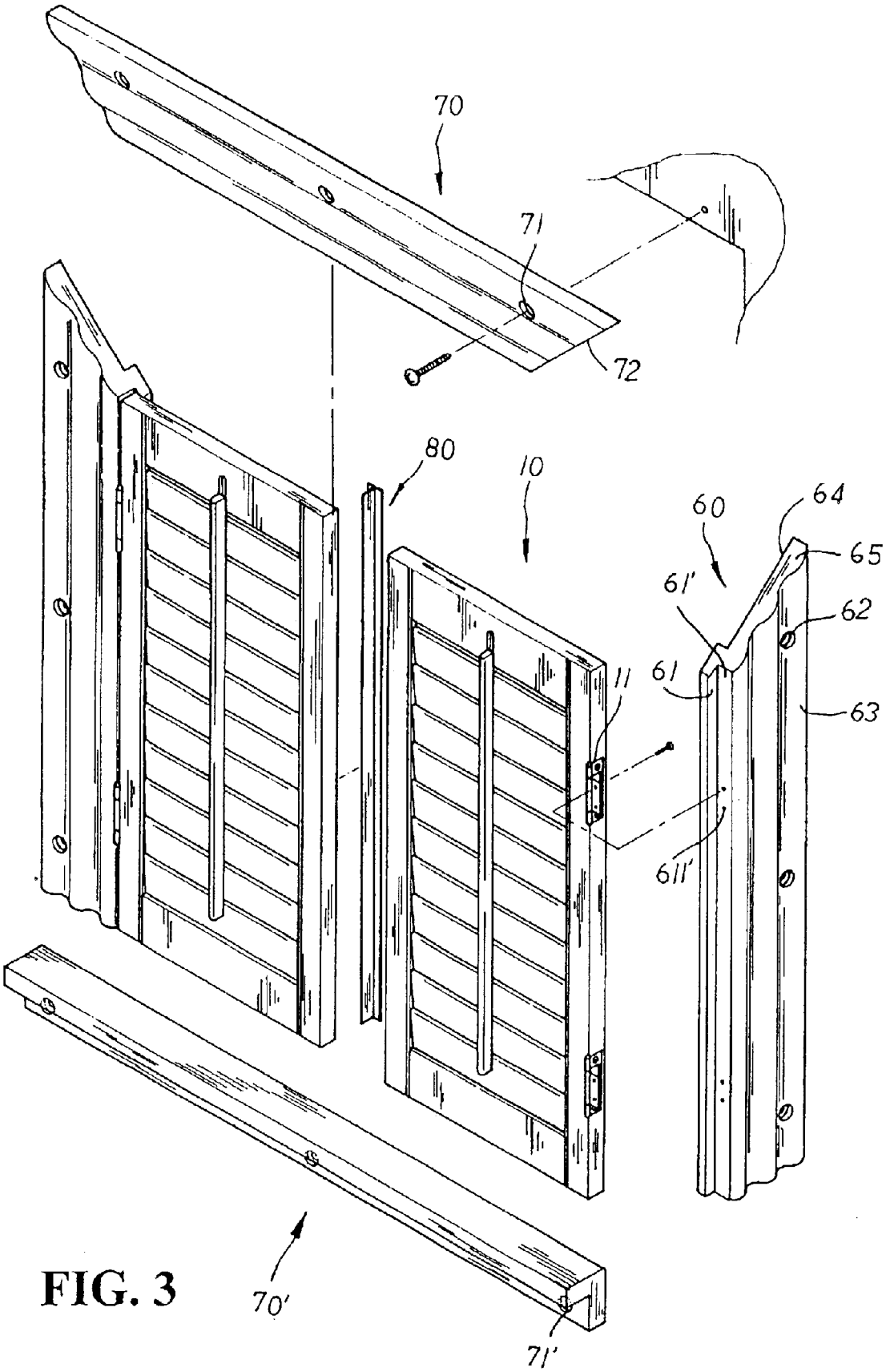
FIG. 3 is a perspective exploded view of the present invention.

Please refer to FIG. 3. The present invention is related to a connection structure for side bracket of door/window Venetian blind, comprising a pair of Venetian door/window units 10, two decoration connection boards 60, an upper frame 70, a lower frame 70', and a stop plate 80. Each Venetian door/window unit 10 is provided with a plurality of pivot couplers 11 equidistantly disposed at one side thereof. The decoration connection boards 60 are integrally molded, each having a stepwise stop face 61 extending at one side thereof, a stepwise pivot face 61' adjacent to the stepwise stop face 61, and a plurality of coupling holes 611' equidistantly disposed at the stepwise pivot face 61' thereon. The other side of each decoration connection board 60 is provided with a plurality of equally spaced stepwise through holes 62 vertically disposed thereon, a front decoration face 63 with various kinds of patterns disposed thereon, a rear adjustment section 64, and a slant coupling end 65 disposed at the top thereof. The upper frame 70 is equipped with a plurality of stepwise fixing holes 71 equidistantly disposed thereon, and tapered coupling slopes 72 disposed at both sides thereof, matching to the slant coupling ends 65 thereof. The lower frame 70' is inverted L-shaped, having a plurality of equally spaced through holes 71' disposed at the side extending at the bottom thereof. The stop plate 80 is T-shaped in section, matching to the corresponding sides of both door/window Venetian units 10 thereof.

Figure 4:
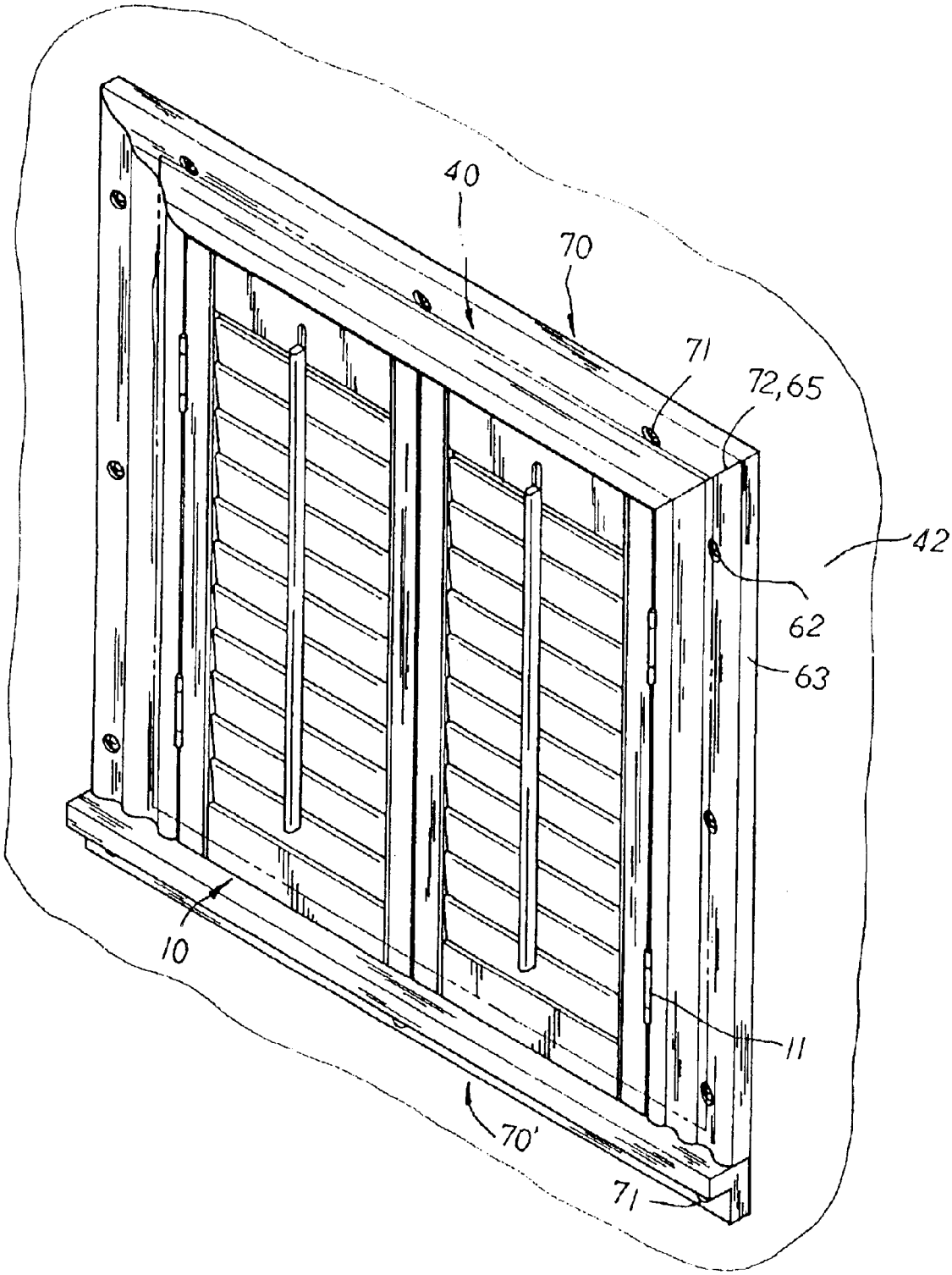
FIG. 4 is a perspective view of the present invention in assembly.

Please refer to FIG. 4. In assembly, the stop plate 80 is securely fixed to the middle of a preset frame 40 to locate both door/window units 10 in closing manner. The decoration connection boards 60 are then mounted onto one side of the door/window units 10 respectively and pivotally fixed thereto via the coupling holes thereof screw joined to the pivot couplers 11 thereof. The rear adjustment sections 64 thereof, adjustably moved according to the size of the preset frame 40, are abutted against outer walls 42 defined by the left/right sides of the preset frame 40 and securely screw joined thereto via the stepwise through holes 62 thereof for location thereof. The upper frame 70 is mounted onto the top edge of both door/window Venetian units 10 with the tapered coupling slopes 72 thereof abutting against the slant coupling ends 65 of the decoration connection boards 60 thereof, and securely fixed thereon via the stepwise fixing holes 71 screw joined to the outer wall 42 defined by the top side of the preset frame 40 thereof Finally, the lower frame 70' is abutted against the bottom edge of both door/window Venetian units 10 and securely fixed to the outer wall 42 defined by the bottom side of the preset frame 40 via the through holes 71 screw joined thereto.

Figure 5:
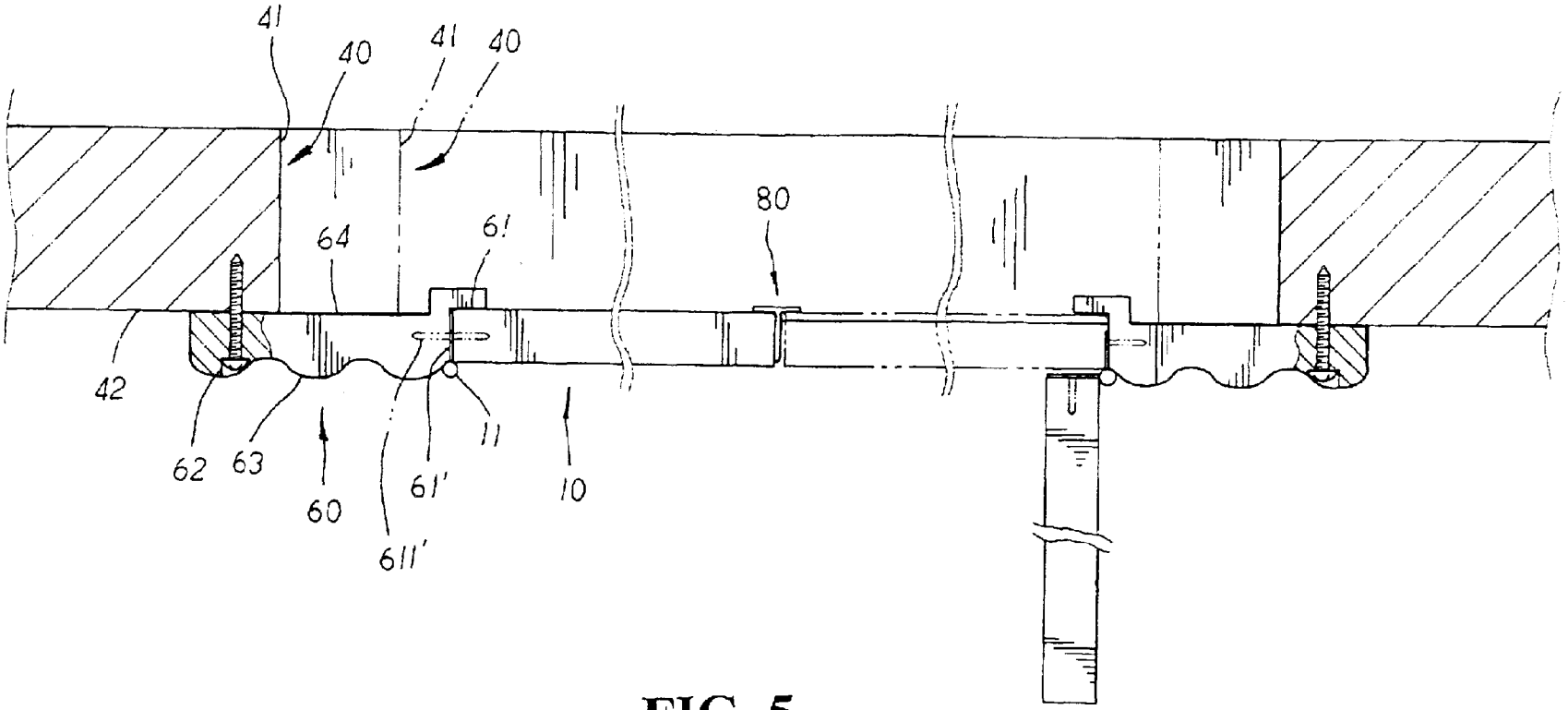
FIG. 5 is a sectional view of the present invention in assembly.

Please refer to FIG. 5. The decoration connection boards 60 are adjusted via the rear adjustment face 64 thereof and securely fixed to the outer walls 42 defined by both left/right sides of the preset frame to form a closed space there-between, effectively sheltering sun or wind from coming in there-through as well as achieving the overall beauty of the door/window Venetian blind in appearance. The decoration connection boards 60, each integrally molded with the front decoration face 63 and the rear adjustment section 64 thereof, are suitably adjusted to preset frames 40 of a wide range without other coupling boards required, economically saving the time in assembly as well as the cost in production thereof.

What is claimed is:

1. A connection structure for connecting two window units to a preset frame comprising:

a) upper and lower frames, adapted to be connected to top and bottom edges of the preset frame;

b) a stop plate; and c) two decoration connection boards, adapted to be connected to left and right edges of the preset frame, each of the two decoration connection boards is integrally molded and has:

i) a stop face extending from a first side thereof;

ii) a pivot face adjacent to the stop face and having a plurality of spaced apart coupling holes, each of a plurality of pivot couplers of each of the two window units are, adapted to be connected to the coupling holes;

iii) a plurality of spaced apart through holes located along a second edge thereof;

iv) a front decoration face;

v) a rear adjustment section; and vi) a slant coupling end located on a top thereof and aligning with one of two tapered coupling slopes of the upper frame, wherein the stop plate has a T-shaped cross section and is, adapted to be connected to the preset frame between the two window units for stopping and locating the two window units.

* * * * *